US005360257A

United States Patent [19]

Sciacca

[11] Patent Number: 5,360,257

[45] Date of Patent: Nov. 1, 1994

[54] FOLDING LUMBAR SUPPORT SEAT

[76] Inventor: Edward T. Sciacca, 73 Todd Rd., Valley Stream, N.Y. 11580

[21] Appl. No.: 102,815

[22] Filed: Aug. 6, 1993

[51] Int. Cl.[5] ..... A47C 1/14; A47C 4/00

[52] U.S. Cl. ..... 297/380; 297/382

[58] Field of Search ..... 297/380–382; 5/432

[56] References Cited

U.S. PATENT DOCUMENTS

| | | | |
|---|---|---|---|
| 597,665 | 1/1898 | Andren . | |
| 1,802,853 | 4/1931 | Weltner . | |
| 2,239,669 | 4/1941 | Blake | 297/380 X |
| 2,457,978 | 1/1949 | Curran . | |
| 2,557,874 | 6/1951 | Kailenta . | |
| 2,957,515 | 10/1960 | Gibson . | |
| 3,419,309 | 12/1968 | Smith | 297/380 |
| 4,518,203 | 5/1985 | White | 297/380 X |
| 4,572,578 | 2/1986 | Perkins | 5/432 |
| 4,597,386 | 7/1986 | Goldstein | 5/432 |
| 4,824,171 | 4/1989 | Hollingsworth | 297/351 |
| 5,190,350 | 3/1993 | Hwang et al. | 297/380 |

FOREIGN PATENT DOCUMENTS

| | | | |
|---|---|---|---|
| 1416 | 1/1908 | United Kingdom | 297/380 |

*Primary Examiner*—Peter R. Brown

[57] ABSTRACT

The folding seat consists of a seat back (4) and a seat bottom (6) corrented by two living hinges (12) and side release buckles (20, 24) mounted on bendable strips (16, 22) secured to the inner ends of the seat back (4) and seat bottom (6). Upon elevation of seat back (4). The folding seat consists of a seat back (4) and a seat bottom (6) connected by two to a 90° angle, the side release buckles (20, 24) are engaged to form the operative position. In this position the seal back (4) has sufficient strength to support a person while also creating lumbar support as it flexes in response to the size and shape of the user.

3 Claims, 1 Drawing Sheet

FOLDING LUMBAR SUPPORT SEAT

BACKGROUND—FIELD OF THE INVENTION

This invention relates to furniture and, more particularly, to folding seats that provide back support.

BACKGROUND—DESCRIPTION OF PRIOR ART

Folding seats that provide back support are not designed to yield to the size and shape of the user. Their construction precludes them from responding to the lumbar curve of the small of the back. Sitting for prolonged periods of time without the benefit of this support causes discomfort. Hence, there remains a need for a folding seat that will provide lumbar support. U.S. Pat. Nos. 4,824,171 to Hollingsworth (1989) and 2,457,978 to Curran (1949) disclose rigid backings. In both patents, the placement of support strips high up on the side of the backing, renders the backing inflexible. The seat back portion can not bend in response to the weight and contour of the user and therefore does not satisfy the need for lower back support. U.S. Pat. No. 2,957,515 to Gibson (1960) discloses a seat back portion that is not supported by strips. In this case, a tubular metal frame is employed. This frame is not resilient and does not provide support to the curve of the lower back.

Existing seats are wider than the area allotted at many stadiums. This causes discomfort for spectators on both sides of the user. This problem is inherent in seats which employ strips running from the forward side of the seat to the top side of the back. U.S. Pat. No. 3,419,309 to Smith (1967) discloses a seat that is wide enough to accommodate an adult person while avoiding interference from the support strips. Since the seat is made to surround the user, it will always be wider the person. By its nature, the seat is both too wide for many stadiums and too narrow to accommodate large people.

SUMMARY OF THE INVENTION

It is an object of the seat to achieve lumbar support through a seat back portion that flexes in response to the size and shape of the user.

Another object of the seat is to present a reduced surface area which can accommodate people of all sizes.

Still another object of the seat is to provide compact dimensions for both storage and transportation.

Other objects, features and advantages of the seat will be found in the detailed description which follows hereinafter as illustrated in the accompanying drawing.

DESCRIPTION OF THE INVENTION

Figure 1:
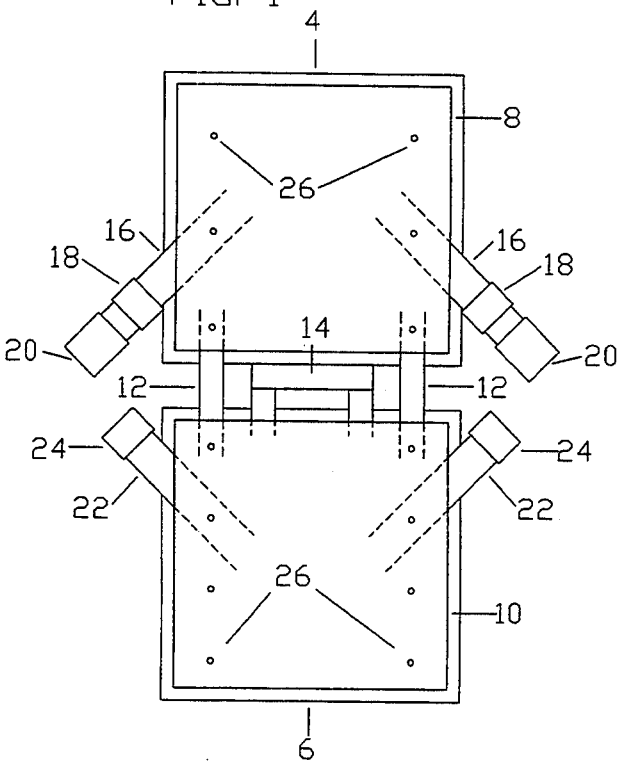
FIG. 1 depicts the underside view of the seat.
Figure 2:
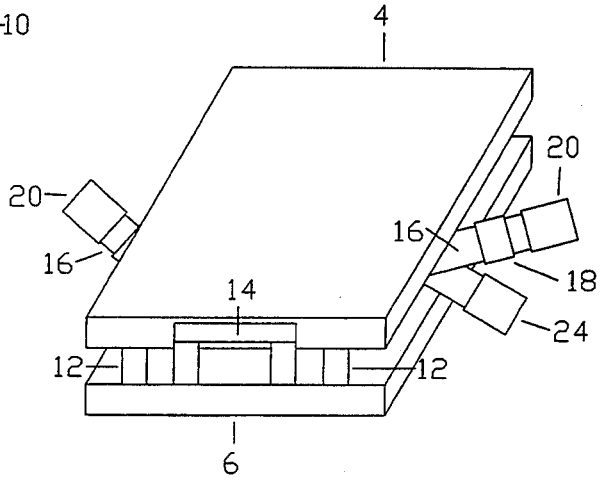
FIG. 2 depicts the closed view of the seat in the most compact position, as seen from the perspective where the seat back and the seat bottom are hinged together
Figure 3:
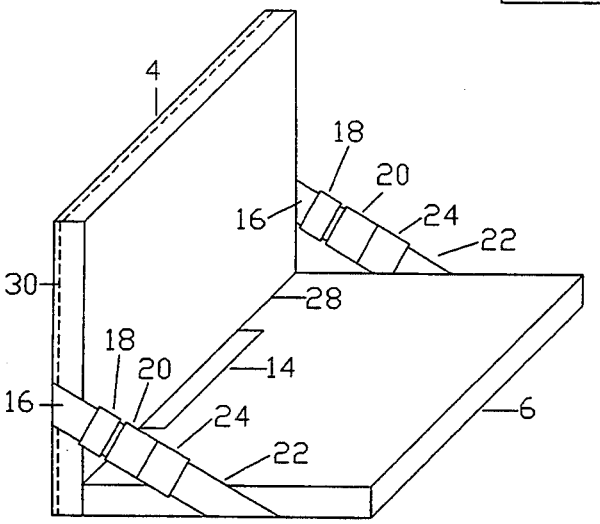
FIG. 3 is the opened view of the seat in an operative position.

A typical embodiment of the seat is illustrated in FIG. 1 (backing view), FIG. 2 (closed view), and FIG. 3 (operative view).

In FIG. 1 ABS thermoplastic plates 8 and 10 are mounted to the backing of the seat back 4 and the seat bottom 6 with phillips screws/finishing washers 26. The ABS plates 8 and 10 conceal the staples used to secure the webbing 16, 22, 12, 14 and the staples used to secure the vinyl to the underside of the seat back 4 and the seat bottom 6. Additionally, the ABS plates 8 and 10 are flexible and impact resistent. Webbing 16, 22 is equipped with the male 20 and female 24 components of the side release buckles; a commercially available product. TRIGLIDES TM 18, also commercially available, prevent the webbing from slipping and also enable the seat back 4 and seat bottom 6 to be oriented at the preferred angle. Webbing forms two living hinges 12 connecting the seat back 4 and seat bottom 6, and also forms the seat handle 14.

In FIG. 2 the seat is shown in a closed, compact postion. A seat back 4 and seat bottom 6 contain plywood. This material accepts the ¼" staples employed, is lightweight and able to flex without cracking. Polyurethane foam is placed on top of the plywood and covered with vinyl. The vinyl is stretched over the foam and stapled to the underside of the plywood to form the seat back 4 and seat bottom 6. A handle 14 extends from the closed position.

FIG. 3 shows the seat in the operative, locked position. By engaging the side release buckles 20, 24 the seat back 4 and seat bottom 6 come together to form an angle of just under 90°. A temporary transverse seam is created 28 between the seat back 4 and seat bottom 6. The handle 14 is partially extended into the seat. Contained within the seat back 4 is the flexible backing 30 made of plywood.

While the embodiment of the seat has been shown and will be understood that the seat is not limited thereto. In view of the foregoing teachings, modifications may be made within the scope of the seat by one of ordinary skill in the art to which the seat pertains. For example, as discussed above, the ABS plates 8 and 10 could be constructed of any suitable material and it could be integrated with the seat back 4 and seat bottom 6 without departing from the true spirit of the applicant's seat. The hinge 12 may be likewise replaced by a suitable material without departing from the teachings of the seat. Thus, it is contemplated by the appended claims to cover any modification and any other embodiment which constitutes the salient features of the seat.

I claim:

1. An article of furniture for holding a sitting human being, comprising a) two rectangular cushions of sufficient size to accommodate a human with one representing a back portion and the other a bottom portion b) said cushions to contain a flexible backing which is distinct from its face surface c) a plurality of bendable elongated narrow strips having first and second ends d) some said strips having first ends connected to a bottom end of the back portion and second ends connected to a rear end of the bottom portion form a "living" hinge between said cushions e) two buckles f) other of said strips, equipped with said buckles, having first ends connected below a mid-point of a side edge of the back portion, and second ends connected at a point on a side edge of the bottom portion that is intermediate the ends thereof g) whereby, upon elevation of said back portion, a vertical angle to said bottom portion is achieved and upon engagement of said buckles, the flexibility of the backing and the location of the connection points of the strips on the back portion form a flexing means for allowing the back portion to adjust to the contour of the user's back providing flexing in a top to bottom direction h) whereby, the article is sized such that an occupant is not confined by said strips equipped with said buckles.

2. An article of furniture in claim 1, wherein a) a durable, yet flexible plate is secured to said backing of said cushions b) whereby, a human can utilize the article on both hard and soft surfaces.

3. An article of furniture in claim 2, wherein a) upon disengagement of said buckles, said hinge permits a 270° counter clockwise movement of said back portion from said vertical angle with said bottom portion, allowing said plates to rest on top of each other b) whereby, compact dimensions are achieved for storage and transportation.

* * * * *

UNITED STATES PATENT AND TRADEMARK OFFICE

CERTIFICATE OF CORRECTION

PATENT NO. : 5,360,257

DATED : Nov. 1, 1994

INVENTOR(S) : Edward T. Sciacca

It is certified that error appears in the above-indentified patent and that said Letters Patent is hereby corrected as shown below:

Title page, item [57], col. 2, ABSTRACT: should read--

The folding seat consists of a seat back (4) and a seat bottom (6) connected by two living hinges (12) and side release buckles (20,24) mounted on bendable strips (16,22) secured to the inner ends of the seat back (4) and seat bottom (6). Upon elevation of seat back (4) to a 90° angle, the side release buckles (20,24) are engaged to form the operative position. In this position the seat back (4) has sufficient strength to support a person while also creating lumbar support as it flexes in response to the size and shape of the user--.

Column 2,

Claim 1 ...d should start new paragraph and should be aligned with other alpha characters.

Signed and Sealed this

Third Day of January, 1995

Bruce Lehman

*Attest:*

BRUCE LEHMAN

*Attesting Officer*

*Commissioner of Patents and Trademarks*